United States Patent [19]

Ragen

[11] Patent Number: 4,691,473

[45] Date of Patent: Sep. 8, 1987

[54] CIRCULAR PLANT MOBILE

[76] Inventor: Peter D. Ragen, 17055 W. Victor Rd., New Berlin, Wis. 53151

[21] Appl. No.: 707,884

[22] Filed: Mar. 4, 1985

Related U.S. Application Data

[63] Continuation-in-part of Ser. No. 638,727, Aug. 6, 1984, abandoned.

[51] Int. Cl.[4] ..... A01G 9/02

[52] U.S. Cl. ..... 47/67; 248/315

[58] Field of Search ..... 47/67, 66; 220/91, 92, 220/95, 96, 94 R, 94 A; 215/100 A; 294/31.2; 248/315, 312.1, 318

[56] References Cited

U.S. PATENT DOCUMENTS

| | | | |
|---|---|---|---|
| 415,984 | 11/1889 | Stern | 220/91 |
| 686,841 | 11/1901 | Bertels | 220/95 |
| 1,369,965 | 3/1921 | Comstock | 47/67 |
| 1,698,915 | 1/1929 | Kircher | 220/91 |
| 1,863,138 | 6/1932 | Le Sauvage et al. | 220/94 R |
| 2,601,190 | 6/1952 | Wells | 220/95 |
| 3,013,758 | 12/1961 | Smith | 47/67 |

*Primary Examiner*—Robert A. Hafer
*Assistant Examiner*—Bradley M. Lewis
*Attorney, Agent, or Firm*—Wheeler Law Firm

[57] ABSTRACT

A circular plant mobile comprising a plant pot supporting ring and a hanging hoop that are pivotably related to one another and may be locked either in plant supporting position with the ring at right angles to the hoop or in a position in which the ring and the hoop lie in the same plane for storage or shipping, the lock being made more secure because it is secured against unlocking by the presence of the pot within the ring, and pot supporting brackets that may be hung from the ring to further increase support for a pot or to alter its location.

16 Claims, 19 Drawing Figures

CIRCULAR PLANT MOBILE

This invention relates to a circular plant mobile. This application is a continuation-in-part of my application Ser. No. 638,727 filed Aug. 6, 1984 and now abandoned in favor of this application.

BACKGROUND OF THE INVENTION

Hanging plant holders in which a circular pot supporting ring is welded to a hoop forming most of a circle are well known. This invention provides a plant support in which the pot supporting ring is capable of rotating with respect to the hoop so that it may be stored flat. It further aims at providing a structure in which, when the plant supporting ring is rotated to a plane at right angles to the hanging hoop, the parts may be locked in that relationship by inserting a pot in the pot supporting ring. The physical arrangement of the parts is such that with a pot in the ring it is not possible to disengage the hoop from its position locking it at right angles to the pot supporting ring. A number of embodiments are disclosed that achieve that result.

SUMMARY OF THE INVENTION

The invention consists of a plant pot supporting ring with a supporting hoop which may be swung from a position parallel to the plant pot supporting ring to a position at right angles to the plant pot supporting ring for use and in which the hoop and the plant pot supporting ring have complementary locking structures that are so positioned that the ends of the hoop must be compressed inwardly to allow pivoting to occur but cannot be compressed inwardly when a pot is in place in the plant pot supporting ring.

A number of embodiments are shown using different locking structures. In addition a form of hoop is shown having support points at several different locations for flexability in arrangement. Finally, a pot support bracket is shown which may assist in supporting pots of certain shapes more effectively.

DESCRIPTION OF THE DRAWINGS

FIG. 19 is a view like that of FIG. 18 but with the modified opening applied to the structure of FIG. 1.

DETAILED DESCRIPTION

Figure 1:
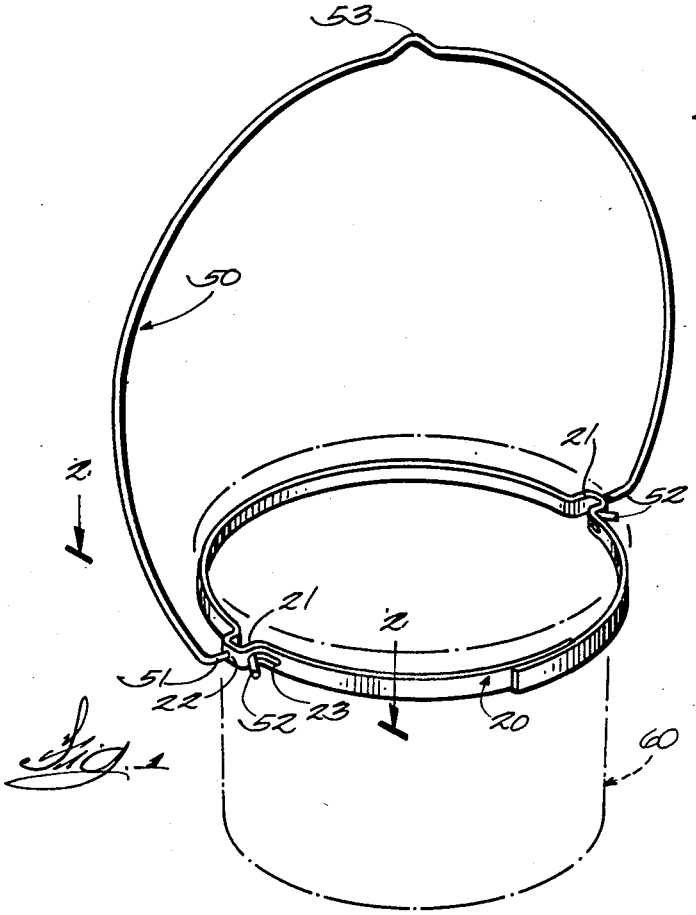
FIG. 1 is a perspective view of the circular plant mobile of my invention with a plant pot shown in phantom lines.
Figure 6:
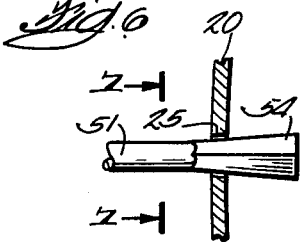
FIG. 6 is a view similar to FIG. 5 showing a modified form of locking means.
Figure 7:
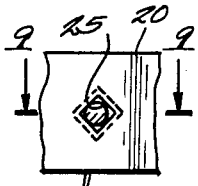
FIG. 7 is a side elevational view on line 7—7 of FIG. 6.
Figure 8:
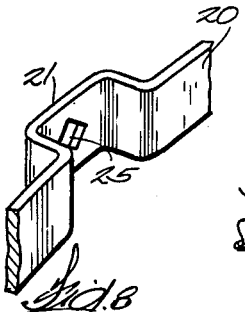
FIG. 8 is a perspective view of the same device.
Figure 9:
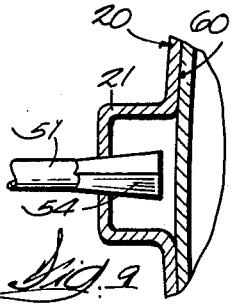
FIG. 9 is a cross-sectional view on line 9—9 of FIG. 7.

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Looking first at the device shown in FIGS. 1 through 4 all of my improved devices include a plant pot supporting ring shown generally as 20 and a hoop shown generally as 50. In the device shown in FIG. 1 ring 20 is provided with a pair of opposed offsets 21 each of which is pierced at 22 to form a pivot on horizontal runs 51 of hoop 50 which are generally straight and lie on a diameter of ring 20. In the FIG. 1 embodiment a slot 23 is positioned partly in the circumference of ring 20 and partly in offset 21 to receive hook portion 52 of hoop 50.

Figure 2:
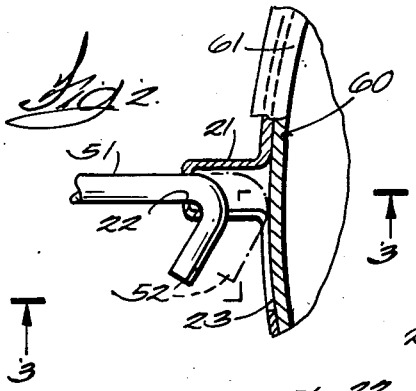
FIG. 2 is a cross-sectional view on line 2—2 of FIG. 1.
Figure 3:
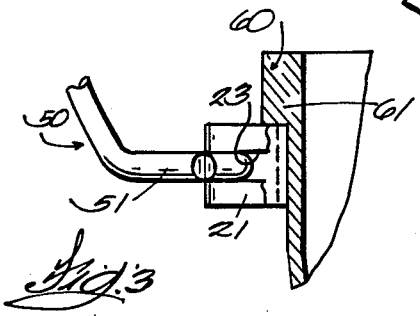
FIG. 3 is a cross-sectional view on line 3—3 of FIG. 2.

As may be seen in all the FIGS. 1 through 3, when hook 52 of hoop 50 is in slot 23 ring 20 cannot rotate with respect to hoop 50. It can also been seen that when a pot 60 is placed in ring 20 so that the rim of put 60 rests on top of ring 20, hook 52 is obstructed by pot 60 from leaving offset 21 and slot 23 so that it is not possible to disengage the lock and ring 20 is secured against rotation with respect to hoop 50. This is shown graphically in FIG. 2 where the phantom line for hook 52 shows that it cannot disengage even though sideward pressure is put on hoop 50 in a disengaging direction. Normally tension in hoop 50 biases ends 51 outwardly.

Figure 10:
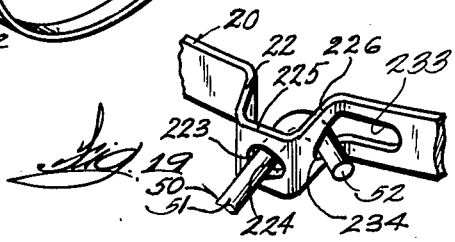
FIG. 10 is a perspective view of a further modification of my device.
Figure 10:
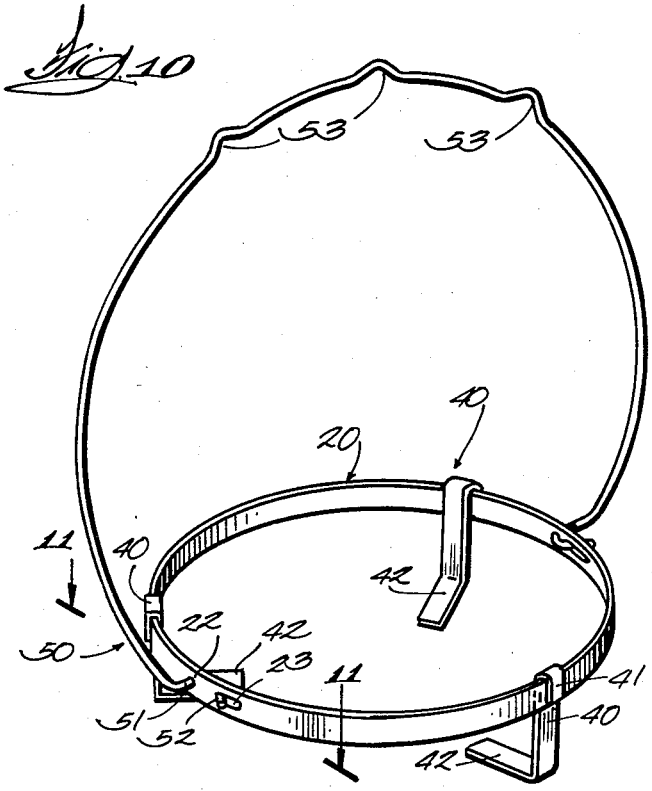

At least one hanging loop 53 is provided in hoop 50, but as shown in FIG. 10 additional loops 53 may be provided for holding the hanger in different positions for use in a mobile.

Figure 4:
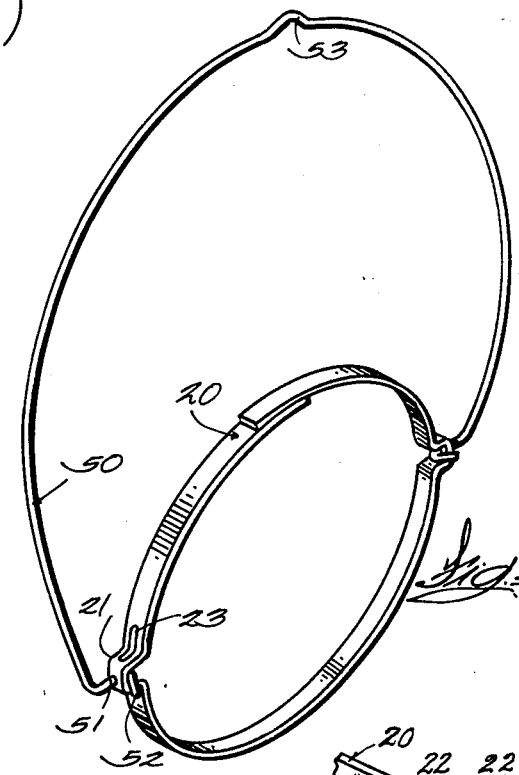
FIG. 4 is a perspective view of the device of FIG. 1 in the folded position.

FIG. 4 shows the device of FIGS. 1 through 3 in its folded position. This position is achieved by removing pot 60 from ring 20 and pushing inwardly on the sides of hoop 50 so that straight rods 51 are pushed farther into hole 22 and hook 52 is pushed inwardly to disengage from slot 23 to lie within the circumference of ring 20. In that position ring 20 may freely swing to a position where it is flat in the plane of hoop 50 as shown in FIG. 4 and when the sides of hoop 50 are released hook 52 will secure ring 20 in that position also by reason of engagement with offsets 21 in ring 20 as shown in FIG. 4.

Figure 5:
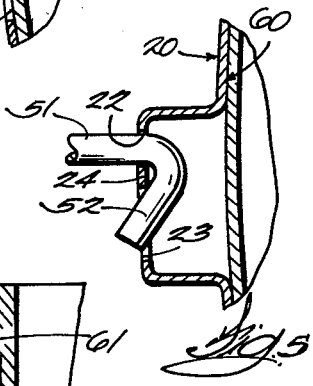
FIG. 5 is a view similar to FIG. 2 of a modified embodiment of my invention.

FIG. 5 shows a variation of the device shown in FIGS. 1 through 4 in which offset 21 is wide enough to contain the entire width of slot 23 along-side hole 22 which serves as the pivot. The web 24 separates hole 22 from slot 23.

It will be apparent from a consideration of the views of FIGS. 1 through 5 that it is not essential that hook 52 extend in a plane at right angles to hoop 50 but could lie in the same plane as hoop 50, extending either upwardly or downwardly with respect to ring 20 when the parts are in their use position.

FIGS. 6 through 9 show a variation in which straight run 51 of hoop 50 is not provided with a hook 52 but instead is provided with an enlarged diamond shaped head 54 engaging a diamond-shaped hole 25.

Figure 13:
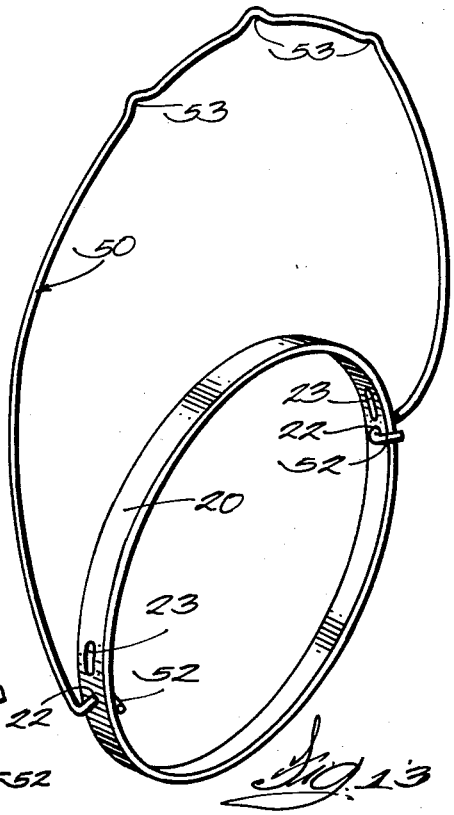
FIG. 13 is a perspective view of the device of FIG. 10 in folded position.
Figure 12:
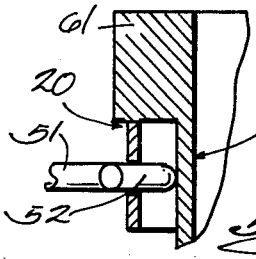
FIG. 12 is a cross-sectional view on line 12—12 of FIG. 11.

FIGS. 10 through 13 show a further modification of my device illustrating that offset 21 is not absolutely necessary. As shown in FIG. 10 hole 22 and slot 23 are adjacent one another in ring 20. As may be seen in FIG. 11 if the dimensions of the parts are correct hook 52 does not seriously interfere with placing pot 60 in ring 20 so that rim 61 is supported on ring 20. FIG. 12 shows the same structure in vertical cross-sectional view. FIG. 13 shows the structure folded.

FIGS. 10 and 13 also show the use of several hanging loops 53. These may be useful, for instance, in building a mobile in which the right hand loop 53 would be supported from one higher structure and the left-hand loop 53 would be supported from a different higher structure. Lower structures might be supported from straight runs 51 or even from the brackets about to be described although those are intended primarily as supports for pots 60 of various shapes.

In FIG. 10 a set of brackets 40 is provided each of which has a flat hook 41 at the top to engage ring 20 and a horizontal leg 42 at the bottom to support a plant pot. Such brackets would be useful in a number of situations, for instance in supporting pots of smaller diameter, or supporting pots at a different elevation, or supporting pots that lack a rim 61. As many brackets 40 could be used as were needed in a particular situation, and they could be used on any of the devices shown in the various figures.

Figure 14:
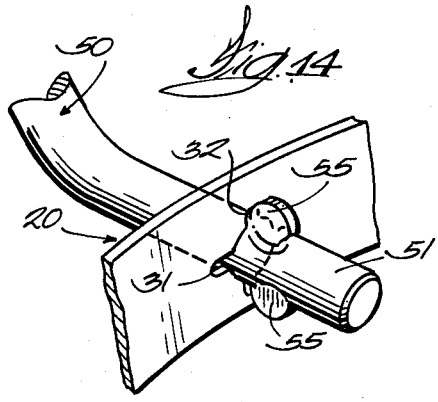
FIG. 14 is a fragmentary greatly enlarged perspective view of a modified locking device.
Figure 15:
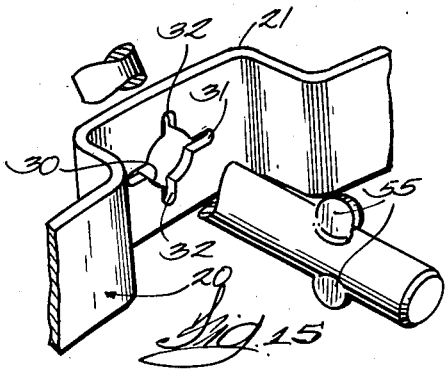
FIG. 15 is similar to FIG. 14 but less magnified.
Figure 11:
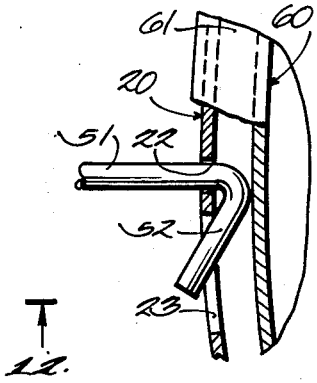
FIG. 11 is a cross-sectional view on line 11—11 of FIG. 10.
Figure 16:
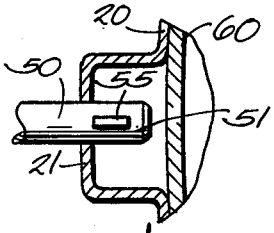
FIG. 16 shows the same device in a fragmentary top plan view with a portion of a pot shown in cross-section.

The modification of FIGS. 14 through 16 is similar to the modification shown in FIGS. 6 through 9 in that no slot 23 is required for the locking means, because the form of the locking means is different. The hole 30 analogous to hole 22 in the other embodiments is formed with four lobes, two horizontal lobes 31 and two vertical lobes 32 which are vertically opposed to one another. The lobes 31 and 32 are large enough to catch on flanges 55 but not large enough to permit them to pass through hole 30. In that manner when flanges 55 are lined up with lobes 32 of hole 30 the structure is locked like the structure shown in FIG. 10 with ring 20 at right angles to hoop 50, while when flanges 55 are lined up with lobes 31 of hole 30 the ring is held in the plane of hoop 50. All of the lobes 31 and 32 may be made of equal size or the size may be varied so that when the parts are in parallel position they may be disassembled. However, I prefer to assemble the parts before flanges 55 are formed and then form flanges 55. As shown by FIGS. 14 and 16 the same structure may be provided whether or not there is an offset 21 in ring 20. WQhen ring 20 is at right angles to hoop 50 a pot 60 in ring 20 will keep ends 51 of hoop 50 from moving inward, so the parts are locked in place.

Figure 17:
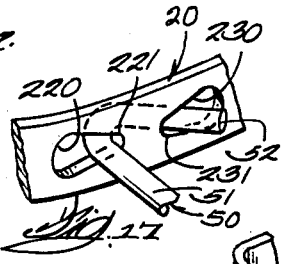
FIG. 17 is a fragmentary perspective view of the pot supporting ring and hoop of FIG. 10 with modified openings.
Figure 18:
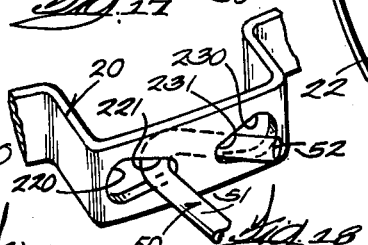
FIG. 18 is a view like that of FIG. 17 but with the modified openings applied to the FIG. 5 structure.

FIGS. 17–19 show a modified form for the openings that receive portions 51 of the hoop and portions 52 of the hoop, as the modification applies to the structures of FIGS. 10,5 and 1, respectively.

In FIG. 17 the ring 20 of FIG. 10 is provided with an opening 220 at each side to receive run 51 of hoop 50. Opening 220 has a narrowed and 221 smaller or at least as small as opening as the diameter of run 51 of hoop 50. Similarly, ring 20 has a second hole or opening 230 with a narrow end 231. Hole 230 receives hook 52 of hoop 50 but end 231 is smaller than or at least as small as the diameter of hook 52. Narrow ends 221 and 231 are at the parts of openings 220 and 230 that are closest together so that when run 51 and hook 52 move outward with respect to ring 20 they catch in narrow ends 221 and 231 of the respective openings due to the connection between 51 and 52 that forms the hook 52. This fixes hoop 50 firmly in place and prevents movement. Pot 60 holds parts 51 and 52 outward while it is in place, but removal permits easy inward movement. The modified holes give added security against movement without added parts.

FIG. 18 is similar, but the modified holes 220, 230 with narrow adjacent ends 221, 231 are applied to each offset 22 on right 20 as the hoop is shown in FIG. 5.

In the same way FIG. 19 shows a ring 20 as shown in FIG. 1 with offsets 21, 22 and openings 223, 233 in each offset. The openings have adjacent narrow ends 224, 234 to secure parts 51 and 52 of hoop 50 against movement when hook 52 moves outward. Because of the size of offset 22 narrow end 224 is not as clearly defined and the angle between the sides is greater, but the deviation from roundness toward end 234 still helps hold runs 51 and 52 steady with respect to ring 20. Even if hole 223 is completely round and only hole 233 has a tapered end 234 the hook 52 will be stabilized in any of the structures of FIGS. 17–19 or analogous forms.

Although the drawings show a metal ring 20 and other parts of metal it will be evident that other materials could be used, particularly in ring 20, and that offset 21 could be molded and could contain cavities within which hole 22 and slot 23 would be provided and which would attractively conceal hook 52. Other variations are possible and I intend the scope of this disclosure to be limited only by the following claims.

I claim:

1. In a device for supporting hanging plant pots and the like consisting of a ring supporting a plant pot at the rim of the pot and a ring supporting hoop, the novelty comprising:

non-removable means pivoting the said ring from the said hoop including pivot holes in the ring, said hoop having two free ends each extending through a said pivot hole, cooperating locking means on said ring and said hoop comprising:

said free ends being shaped so that each said end engages a complementary structure on said ring when said locking means is in its locked configuration;

complementary structures on said ring capable of engaging said free ends of said hoop to prevent relative rotation between said ring and said hoop, said free ends of said hoop being shaped so that each said free end may extend through a pivot hole in said ring, said free ends being disengaged from said complementary structures on said ring when said locking means is in its unlocked configuration, said locking means being able to secure said ring against pivotal motion with respect to said hoop except for storage, said free ends each being positioned to substantially abut a pot placed in said ring, said free ends being movable radially inwardly of said ring to disengage said free ends from said complementary structures to unlock, whereby when said ring is filled with a pot, said free ends cannot be moved radially inwardly enough to release said locking means from its locked configuration.

2. The device of claim 1 in which said locking means further comprise a bend in a said free end of said hoop shaped to engage said complementary structure on said ring and retain said ring in a fixed position with respect to said hoop when said bend moves outwardly against said ring.

3. The device of claim 1 wherein said locking means further comprises an opening in said ring, said free ends each being provided with an end portion curved to be engagable with said opening to retain said ring in a plane at right angles to the plane of said hoop.

4. The device of claim 1, wherein said pivot holes in the ring are diametrically opposed, said hoop extending through said pivot holes, said complementary structure comprising a second opening in the ring adjacent the pivot hole, each said free end extending through the pivot hole and shaped to be engagable with the second opening in the ring by moving said free end radially outwardly.

5. The device of claim 1, wherein said pivot holes in the ring are diametrically opposed, said hoop extending through said pivot holes, said complementary structure comprising a second opening in the ring adjacent the pivot hole, said free end extending through the pivot hole and shaped to be engagable with the second opening in the ring by moving said free end radially outwardly, said second opening being elongated in a direction along the ring and said free end of said hoop having the form of a hook engagable with said slot when moved radially.

6. The device of claim 1 in which said locking means further comprising ring engaging means on said hoop within the ring preventing it from moving radially outward through a said pivot hole, said hoop being shaped to resiliently bias the portion extending through the pivot holes outwardly to tend to urge the ring engaging means toward the ring, and wherein said ring engaging means on said hoop includes a part engagable with the ring to secure said ring against pivoting movement.

7. The device of claim 6 wherein said means pivotally supporting the ring from said hoop includes a straight portion of the hoop and said ring engaging means includes a portion of the hoop within said ring which extends in a different direction to engage the ring in at least one ring position to prevent pivotal movement when the ring engaging means moves outward.

8. The device of claim 1 in which said hoop has straight portions extending through said pivot holes, each said straight portion of said hoop terminating in a hook, and complementary structures on said ring to engage with said hook to interfere with rotation of the ring.

9. The device of claim 1 in which the ring has an outwardly offset portion, said means pivotally supporting the ring being located in said offset portion of said ring.

10. The device of claim 9 in which the means pivotally supporting the ring from the said hoop comprises a pair pivot holes which are diametrically opposed in said ring, said free ends each extending through a said pivot hole, said locking means further comprising a bend in a said free end of said hoop shaped to engage said ring and retain said ring in a fixed position with respect to said hoop when said bend moves outwardly against said ring.

11. The device of claim 9 wherein said complementary structure comprises an opening in said ring, said hoop being provided with an end portion engagable with said opening to retain said ring in a plane at right angles to the plane of said hoop.

12. The device of claim 9 wherein said pivot holes in the ring are diametrically, said hoop extending through said pivot holes, said complementary structure comprising a second opening in the ring adjacent the pivot hole, said free end extending through the pivot hole and shaped to be engagable with the second opening in the ring by moving said free end radially outwardly.

13. The device of claim 9, wherein said pivot holes in the ring are diametrically opposed, said complementary structure comprising a second opening in the ring adjacent the pivot hole, said free end extending through the pivot hole and shaped to be engagable with the second opening in the ring my moving said free end radially outwardly, said second opening being elongated in a direction along the ring and said free end of said hoop having the form of a hook engagable with said second opening when moved radially.

14. The device of claim 9 in which the means pivotally supporting the said ring from the said hoop includes pivot holes extending through the ring, the hoop extending through the pivot holes, said locking means further comprising ring engaging means on said hoop within the ring preventing it from moving radially outward through a said pivot hole, said hoop being shaped to resiliently bias the extending through the pivot holes outwardly to tend to urge the ring engaging means toward the ring, and wherein said ring engaging means on said ring includes a part engagable with the ring to secure said ring against pivoting movement.

15. The device of claim 14 wherein said means pivotally supporting the ring from said hoop includes a straight portion of the hoop and said ring engaging means includes a portion of the hoop within said ring which extends in a different direction to engage the ring in at least one ring position to prevent pivotal movement when the ring engaging means moves outward.

16. The device of claim 9 wherein said means pivotally supporting the ring from the hoop includes pivot holes located in said offset portion, said hoop extending through the pivot holes.

* * * * *